United States Patent [19]

Baxter

[11] 3,965,857

[45] June 29, 1976

[54] APPARATUS FOR PRODUCING A UNIFORM METALLIC COATING ON WIRE

[75] Inventor: Lawson J. Baxter, Raytown, Mo.

[73] Assignee: Armco Steel Corporation, Middletown, Ohio

[22] Filed: June 12, 1975

[21] Appl. No.: 586,421

Related U.S. Application Data

[60] Continuation of Ser. No. 462,307, April 19, 1974, abandoned, which is a continuation of Ser. No. 40,791, May 27, 1970, abandoned, which is a division of Ser. No. 695,097, Jan. 2, 1968, Pat. No. 3,523,815.

[52] U.S. Cl. ..... 118/405

[51] Int. Cl.[2] ..... B05C 3/12

[58] Field of Search .... 118/404, 405, 420, DIG. 18, 118/DIG. 19, DIG. 22; 427/431–434; 164/275

[56] References Cited

UNITED STATES PATENTS

| | | | |
|---|---|---|---|
| 2,647,296 | 8/1953 | Shive | 118/405 X |
| 2,647,488 | 8/1953 | Shive | 118/405 X |

*Primary Examiner*—Morris Kaplan

*Attorney, Agent, or Firm*—Melville, Strasser, Foster & Hoffman

[57] ABSTRACT

Wire coating apparatus having a vertically upward wire pass line and wherein a molten coating metal is confined between entrance and exit portions of a common die element through which the wire passes, the exit die being substantially submerged in the molten coating metal.

3 Claims, 4 Drawing Figures

APPARATUS FOR PRODUCING A UNIFORM METALLIC COATING ON WIRE

CROSS REFERENCE TO RELATED APPLICATION

This is a continuation of application Ser. No. 462,307 filed Apr. 19, 1974, now abandoned which in turn was a continuation of application Ser. No. 40,791 filed May 27, 1970 , now abandoned and which in turn was a division of application Ser. No. 695,097 filed Jan. 2, 1968 and entitled "METHOD AND APPARATUS FOR PRODUCING A UNIFORM METALLIC COATING ON WIRE," now U.S. Letters Pat. No. 3,523,815.

BACKGROUND OF THE INVENTION

This invention relates to the continuous hot dip coating of wire with any of the conventional coating metals, such as zinc and its alloys, aluminum and its alloys, terne, and the like. The invention has great and particular utility in the coating of iron or steel wire with aluminum, and the embodiment of the invention specifically described will relate to this field. It should be understood, however, that no limitations are to be inferred or implied thereby.

More specifically, this invention relates to a continuous process wherein the wire passes upwardly through the bath of molten coating metal in a substantially vertical path of travel. Such a vertical mode of operation has the obvious advantage that during the period immediately after emerging from the coating bath, the force of gravity acting on the still liquid metallic coating does not tend to destroy concentricity. However, and notwithstanding this great advantage, the art has had great problems in the production of intermediate and heavy weight metallic coatings using such a vertical process.

For example, one of the earliest of the various hot dip procedures was what might be called the "free exit" method in which the wire emerged vertically from a molten metal bath which was covered with a layer of flux. In a later version of this method, the flux was replaced with a non-oxidizing gas. The thickness of the coating produced was dependent almost exclusively on wire speed, and hence it was possilbe to produce a wide range of coating thicknesses. However, the coating applied by this free exit method was very rough, and is considered unacceptable for many commercial applications. These problems are greatly exaggerated in the case of an aluminum coating metal, because of the tendency of this metal to form a tough, gummy oxide which is pulled onto the moving wire and forms a highly irregular coated surface.

U.S. Pat. Nos. 2,914,423 and 3,060,889, both in the name of Earle L. Knapp, are directed in part to a method and apparatus for improving the surface characteristics of a metallic coated wire. Both of these references include the provisions of an exit die through which the wire passes after emerging from the metallic coating bath. This exit die is completely above the normal level of the coating metal in the bath so that the moving wire will pull up the molten coating metal to the die forming an "oxide sock," while the substantially pure metal under the oxide layer is withdrawn as a coating on the wire. While this method is satisfactory for the production of light coating weights, it has been impossible to commercially produce with any degree of consistency an intermediate weight coating.

One commerical application of intermediate weight coatings is in the production of aluminum coated wire for chain link fences. Such wire, to meet the manufacturer's specification, must have a minimum of 0.40 ounces per square foot of wire surface. Because of the cost of the coating material used, it is desirable to stay as close to this minimum level as possible. In addition, the manufacturer also specifies minimum tensile strength requirements, which are equal to the breaking load of the coated wire divided by its cross sectional area. Thus, the thicker coatings make it more difficult to meet the minimum tensile strength requirements. Keeping the foregoing comments in mind, it is therefore the principal object of this invention to provide an apparatus for uniformly and consistently applying intermediate weight coatings (i.e. on the order of 0.50 ounces per square foot) to a steel wire.

SUMMARY OF THE INVENTION

Briefly considered, this invention contemplates that the exit die through which the wire is vertically withdrawn from the coating bath be substantially submerged in the molten coating metal. As the wire enveloped by a still liquid coating emerges from the exit die, a non-oxidizing gas is blown against it at low pressure.

While many factors obviously influence the weight of coating material applied to the wire, including such factors as speed of wire passage, temperature of the wire prior to immersion, temperature of the coating bath, diameter of the wire, amount of clearance between the surface of the wire and the exit die, and possibly others, applicant has discovered that the primary factor in terms of controlling coating weights within the limits of this application is the relative level between the top surface of the exit die and the level of molten metal in the coating bath. That is, the level of molten coating metal may be substantially at or just below the top surface of the exit die. If the molten metal level gets much above the upper die surface, the rough coating characteristic of the "free exit" method described above will result. Also, if the bath level gets below the upper die surface by more than a predetermined amount, the consistently maintainable coating weights would be too light.

DESCRIPTION OF THE PREFERRED EMBODIMENT

In general, the hot dip coating of steel wire includes the steps of thoroughly cleaning or otherwise preparing the surface of the wire for the reception of a molten metal coating. While these preparatory steps do not per se form a part of this invention, it will be understood that the invention contemplates such a pretreatment prior to the time the wire arrives at the molten coating bath.

Exemplary preparatory procedures now in commercial use are described in detail in Sendzimir Patents 2,110,893, 2,136,957, and 2,197,622. In general, these patents contemplate that the wire is cleaned of oils, greases, and the like by passing it through an oxidizing furnace wherein carbonaceous foreign matters are burned from the surface of the strip, and a very thin, controlled oxide coating is formed thereon. The wire is then subjected to a heat treatment in a reducing atmosphere wherein the previously formed oxide layer is removed. Finally, without re-exposing the wire to atmosphere, it is passed directly into a bath of molten coating metal.

Instead of the described treatment in an oxidizing furnace, alkali or other chemical cleaning involving wetting and drying of the strip surface, or even abrasive treatment may be used, so long as the surface of the wire is sufficiently cleaned that an extremely rapid and thorough wetting by the molten metal itself takes place in the coating bath.

Figure 1:
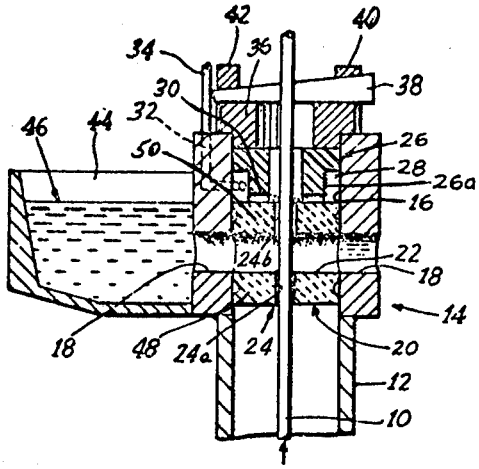
FIG. 1 is a cross sectional view showing a coating compartment according to this invention.
Figure 2:
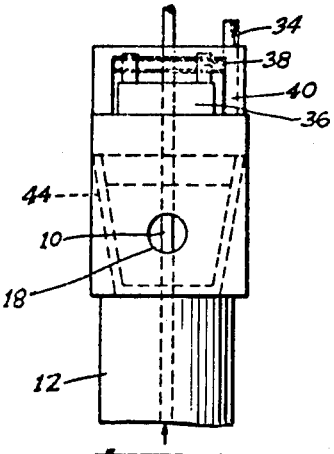
FIG. 2 is an end elevational view of the apparatus shown in FIG. 1 as seen from the right.
Figure 3:
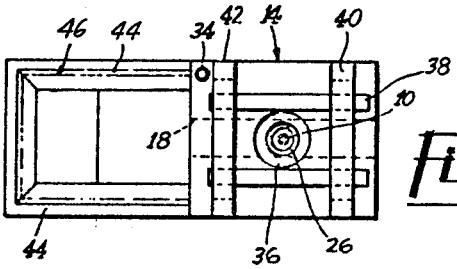
FIG. 3 is a top plan view of the apparatus of FIG. 1.

Turning now to FIG. 1, one form of apparatus for practicing the teachings of this invention has been shown. The wire to be coated is indicated at 10 and, as already indicated, it is to be assumed that the surface of the wire has been adequately prepared to make it receptive to the molten coating metal. The tube 12 is a schematic representation of the hood providing a protective atmosphere for the wire between the time it leaves the reducing furnace and the time it enters the coating bath. It will be understood that this tube will be supplied by conventional means with a suitable protective atmosphere.

The bath of molten coating metal will be maintained within the body portion of the apparatus indicated generally at 14. As seen in the drawings, the body portion is provided with the substantially vertical passage 16, and with the passage 18 which is arranged substantially normal to the passage 16. As will be explained in more detail presently, the intersection of these two passages defines the bath of molten coating metal.

Figure 4:
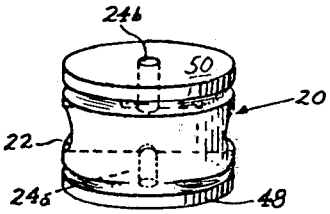
FIG. 4 is a perspective view of the die element.

Snugly maintained within the vertical passage 16 is the die element indicated generally at 20, and shown in perspective in FIG. 4. Referring to that figure at this time, it will be seen that the die element is provided with a horizontal passage 22, and with an intersecting vertical passage indicated generally at 24. The passage 24 includes the lower and upper passages respectively indicated at 24*a* and 24*b*. As shown in FIG. 1, the die element 20 is received in the passage 16 of the body portion 14, and the passages 18 and 22 of the body portion and die element respectively are aligned. The wire to be coated of course passes upwardly through the vertical passages 24*a* and 24*b* in the die element.

The die element 20 should be formed of a very fine-grained material which may be given a very smooth bore in order to obtain a good finish on the coating. Preferably, the material selected should be non-wettable by the molten coating metal and have good wear resistance. Ceramic materials such as "Diamonite" and "Refrax" have been found commercially satisfactory. Carbides having the desired properties may also be used.

Disposed in the passage 16 of the body portion just above the die element 20 is the member indicated generally at 26. As is clearly shown in FIG. 1, this member includes a portion 26*a* of reduced diameter, which in conjunction with the walls of the passage 16 forms the plenum chamber 28. The reduced diameter portion 26*a* of the member 26 is provided with a plurality of radial apertures 30. In the embodiment shown, these apertures are arranged substantially normal to the wire 10, but it is to be understood that this arrangement is not limiting. That is, under certain circumstances, the apertures should be arranged obliquely to the wire axis. In this connection, reference is made to U.S. Pat. No. 3,060,889, in the name of Earle L. Knapp, which discloses a swirl imparting gas finishing nozzle which may be used in connection with this invention. The body portion 14 is provided with the passageway 32. One end of this passage communicates with the plenum chamber 28, and the other end, via the tube 34, is in communication with a supply of finishing gas.

Held against the top surface of the member 26 is the hold down cap 36. It will be seen that the circular hold down cap is held in place by means of the wedges 38 which pass under the hold down brackets 40 and 42 of the body portion 14, and serves to prevent movement of the die element 20 and member 26 due to the wire movement therethrough.

Secured in any suitable manner to the bottom of the body portion 14 and in a position to communicate with the horizontal passage 18 is the molten metal supply trough 44. It will be understood that the entire assembly may be moved vertically in relation to the trough 44, or the die element 20 may be adjusted vertically within the body portion 14, in order to vary the level of the coating metal in the die.

In operation of the apparatus, the trough 44 will be continuously supplied with molten coating metal to the level indicated by the line 46. The relationship between the level of molten metal in the trough 44 and the top surface of the die element 20 is very important facet of this invention, and will be discussed in more detail presently. For present purposes, it will be understood that by maintaining the trough full of molten metal to this level, the aligned passages 18 and 22 will in effect define a reservoir of molten coating metal through which the wire 10 is drawn. In other words, the horizontal passage 22 in effect divides the die element 20 into an entrance die portion 48 having passage 24*a* and an exit die portion 50 having passage 24*b* between which the coating bath is maintained.

Thus the wire 10 with a properly prepared surface passes from the protective atmosphere inside the tube 12, through the entrance die 48 and into the bath of molten coating metal. It emerges from the coating bath through the exit die 50, and is immediately contacted by the finishing gas through the apertures 30. Actual commercial use of the invention has established that optimum finishing requires a non-oxidizing gas such as hydrogen under a relatively low pressure. Such a gas retards oxidation of the still molten coating metal and, under some circumstances, has a slight effect upon coating weight.

It is preferred that the entrance passage 24*a* be up to 0.01 inch smaller in diameter than the exit die passage 24*b*. This prevents the coated wire from rubbing on the wall of the exit die. Thus, a uniform coating is withdrawn around the strand periphery.

Exemplary exit die clearances over the base wire diameter are as follows:

6 Ga. (0.192 inch ctd. wire dia.) (0.188 inch base wire dia.) - use 0.215 inch exit die 9 Ga. (0.148 inch ctd. wire dia.) (0.145 inch base wire dia.) - use 0.169 inch exit die 12 ½ Ga. (0.099 inches ctd. wire dia.) (0.095 inch base wire dia.) - use 0.118 inch exit die For practical purposes a clearance of 0.010 inch to 0.040 inch on the diameter, preferably 0.015 inch to 0.025 inch should be maintained. If the clearance is too small, the coating metal will not feed uniformly with sufficient volume. If the clearance is too large, excess metal will accumulate in globular form on the top surface of the exit die and around the strands, chocking off the apertures 30.

The principle of applying 0.40 oz. minimum coatings to a wire strand involves pulling enough liquid metal into the clearance space between the strand surface and the exit die wall to form a controllable meniscus. This is stabilized at a level near the top surface of the exit die by a combination of wire speed which promotes metal pumping action, die clearance, smoothness of the exit die bore wall, length of the exit bore, hydrostatic head of the melt supply in respect to the top surface of the exit die, fluidity of the coating metal, the downward or lateral pressure of the finishing gas jets, and the rate of aluminum oxidation on the top surface of the meniscus.

For a Diamonite die material and using the above die clearances, the exit die bore length has been designed at ⅜ inch for wear life. This length can be more or less depending on die material. The length of the entrance die is also ⅜ inch. This permits turning a worn die end for end to ream out to a next larger wire size.

The fluidity of the coating metal within the exit die is controlled by the temperature of the passing strand and of the melt supply. Wire temperatures of 1240° to 1270°F are preferred. Lower values will cause an increase in wire coating weight. Higher temperatures tend to form excessive oxide crusts on the top side of the exit die. Wire temperatures in the order of 1350°F. and higher will cause the coating weight to be less. These figures refer to high purity aluminum that melts at about 1220°F. Undoubtedly, both temperature ranges would shift in relation to the melting point of coating metal.

The temperature of the aluminum coating metal bath is not highly critical. A temperature between 1250° and 1300°F. has been found adequate. The preferred range is on the order of 1270° to 1280°F., but it is believed that satisfactory results may be achieved with a temperature ranging from the 1220°F. melting point of aluminum to as much as 1500°F.

Rather surprisingly, wire speed has been found to have very little effect on coating weights. While the evidence is not clear, it appears that faster wire speeds bring about a smoother and more brilliant surface to the coating applied. Thus, commercial operations in excess of 50 feet per minute are to be preferred.

By marked contrast to the above factors, Applicant has found that the relative levels of aluminum in the coating bath and the top surface of the exit die can be utilized to control coating weights over a rather wide range.

It will be understood that the relative levels of the coating metal are determined under static conditions preliminary to feeding the wire. The desired coating weight dictates the height at which the entire coating assembly is positioned relative to the top surface of the metal in the trough (line 46 in FIG. 1).

The following examples show the effect of metal level on coating weight:

| Wire Gage-Ctd. | Wire Speed | Metal Level* | Coating Weight** |
|---|---|---|---|
| | | | (per square feet of wire surface) |
| 6 Gage | 54 FPM | Minus 1/8" | 0.30 oz. |
| | | Minus 1/16" | .36 |
| | | zero | .43 |
| | | Plus 1/16" | .48 |
| | 63 FPM | Plus 1/16" | .69*** |
| 9 Gage | 87 FPM | Minus 1/8" | .30 |
| | | zero | .41 |
| | | Plus 1/16" | .55 |
| | | Plus 1/8" | .62 |
| 12 1/2 Gage | 155 FPM | Minus 3/16" | .30 |
| | | Minus 1/8" | .48 |
| | | zero | .55 |

*Metal level of aluminum supply in respect to top surface of exit die.
**Coating weights for wire temperatures in the order of 1240 to 1270°F. Finish gas jets 30° with the strand except as noted.
***Finish gas jets 90° to wire and impinging tangentially.

The coating device herein described is capable of applying high purity aluminum coating (99.75% purity in the outer coating layer) in the weight ranges of 0.30 oz. Class (0.20 oz. minimum), 0.50 oz. Class (0.40 oz. minimum), and 0.80 oz. Class (0.70 oz. minimum).

It will be seen from the foregoing exemplary data that the level of molten coating metal in the supply may vary from a height approximately 3/16 inch below the level of the top surface of the exit die to a height approximately ⅛ inch above the level of the top surface of the exit die. As is well known in the art, molten aluminum around a rising coated wire strand will form a concave meniscus. Therefore, even though the indicated static level of molten metal is above the top surface of the exit die, the meniscus is kept from expanding over the top surface of the die by controlling the impingement of the finishing gas. Under no circumstances can the molten coating metal be permitted to flow over the top surface of the exit die.

It has now been discovered that if the level of molten metal in the coating bath is substantially equal to the level of the upper surface of the exit die, (i.e. from about plus ⅛ inch to about minus 3/16 inch) good, uniform aluminum coatings can be obtained in a weight up to about 0.80 ounces per square foot of wire surface. As the static level of molten metal in the supply is progressively adjusted to a lower height, coating weights are correspondingly decreased down to a weight of about 0.20 ounces per square foot of wire surface.

It is believed that the foregoing constitutes a full and complete disclosure of this invention. It will be understood that no limitations are to be inferred or implied except as specifically set forth in the claims which follow.

The embodiments of the invention in which an exclusive property or privilege is claimed are defined as follows:

1. In an apparatus for applying a molten coating metal to a wire, which includes a reservoir for said molten coating metal having a vertical passage therethrough, a. a die holder, having a vertical passage therethrough, disposed in said vertical passage through said reservoir, b. a substantially horizontal passage intersecting said passage in said die holder, and communicating with said reservoir, c. a one-piece die element disposed in said die holder, d. said die element having a vertical passage therethrough, defining a path of travel for said wire, e. said die element having a horizontal passge intersecting said vertical passage in said die element, and communicating with the horizontal passage in said die holder, f. said horizontal passage in said die element dividing the vertical passage in said die element into entrance and exit portions and being larger in diameter than said vertical passage, g. said exit portion having a clearance over said wire of from about 0.010 to about 0.040 inch on the diameter, and h. means for centering said wire with respect to said exit die.

2. The improvement claimed in claim 1 wherein said die element is of a fine grained ceramic material.

3. The apparatus claimed in claim 1 wherein said exit portion is larger in diameter than said entrance portion.

* * * * *